United States Patent [19]

Wilcox, Jr. et al.

[11] 4,341,424

[45] Jul. 27, 1982

[54] MOBILE DUAL AUGER CONTINUOUS MINING MACHINE WITH MULTIPLE MOVEMENT CAPABILITIES

[75] Inventors: Arnold G. Wilcox, Jr., Shady Spring; Roger D. Plumley, Crab Orchard, both of W. Va.

[73] Assignee: Fairchild Incorporated, Raleigh, W. Va.

[21] Appl. No.: 199,363

[22] Filed: Oct. 21, 1980

[51] Int. Cl.[3] ..... E21C 27/24; E21C 35/20

[52] U.S. Cl. ..... 299/57; 299/64; 299/71

[58] Field of Search ..... 299/57, 64, 18, 59, 299/71

[56] References Cited

U.S. PATENT DOCUMENTS

| | | | |
|---|---|---|---|
| 2,733,057 | 1/1956 | Letts | 299/57 |
| 2,776,809 | 1/1957 | Barrett | 299/18 |
| 2,920,879 | 1/1960 | Driehaus | 299/64 |
| 2,967,701 | 1/1961 | Wilcox | 299/18 |
| 2,986,385 | 5/1961 | Densmore | 299/57 |
| 3,000,620 | 9/1961 | Densmore | 299/64 |
| 3,026,098 | 3/1962 | Wilcox | 299/49 X |
| 3,190,697 | 6/1965 | Gonski | 299/64 |
| 3,269,776 | 8/1966 | Munger | 299/71 X |
| 3,282,403 | 11/1966 | Todd | 198/139 |
| 3,304,123 | 2/1967 | Coffman | 299/57 X |
| 3,305,268 | 2/1967 | Todd | 299/18 |
| 3,306,667 | 2/1967 | Todd | 299/57 |
| 3,858,940 | 1/1975 | Lagowski | 299/18 |

*Primary Examiner*—Ernest R. Purser
*Attorney, Agent, or Firm*—Cushman, Darby & Cushman

[57] ABSTRACT

A continuous mining machine comprising a cutter assembly including a cutter frame, a pair of oppositely pitched independently vertically movable auger cutters having their axes of rotation disposed generally parallel with respect to one another, a mobile assembly disposed rearwardly of the cutter assembly and including a mobile frame having a pair of parallel power driven endless track units mounted thereon for independent pivotal movement of each unit about a common generally transversely extending horizontal axis disposed adjacent to the forward portion of the track units, a yoke assembly between the mobile assembly and the cutter assembly including a yoke frame pivotally interconnected with the mobile frame for pivotal movement about an axis generally parallel with the common pivotal axis of the track units and pivotally interconnected with the cutter frame for pivotal movement about a generally upright axis extending generally perpendicularly to the pivotal axis of the yoke frame with the mobile frame, and conveyor means including a forward section carried by the cutter frame and a rearward section carried by the mobile frame for conveying coal cut by the auger cutters longitudinally rearwardly of the machine, the forward portion of the rearward conveyor section being mounted on the mobile frame for pivotal movement about an axis parallel to the common pivotal axis of the track units.

11 Claims, 11 Drawing Figures

10
14
200
198
248
182
180
244
246
194
236
250
196
232
234
190
238

58
12
10
60
218
220
16
130
204
214
216
14
238
190
192
18

50
50
22
46
44
48
10
52
54
64
12
58
18

MOBILE DUAL AUGER CONTINUOUS MINING MACHINE WITH MULTIPLE MOVEMENT CAPABILITIES

This invention relates to continuous mining machinery and more particularly to improvements in self-propelled crawler type continuous mining machines.

The utilization of a pair of oppositely pitched oppositely rotated auger cutters in connection with a shortwall mining frame to achieve continuous operation is disclosed in Wilcox U.S. Pat. No. 3,026,098. The mining machine disclosed in the aforesaid Wilcox patent has been produced commercially for many years and is known in the commercial industry as the Wilcox Continuous Miner. Various auxiliary equipment and improvements have been developed over the years relating to this equipment, see for example, Todd U.S. Pat. Nos. 3,282,403; 3,305,268; and 3,306,667; and Lagowski U.S. Pat. No. 3,858,940. Reference is also made to a more recent improvement disclosed in commonly-assigned application Ser. No. 39,744, filed May 16, 1979. Throughout the 20-plus years of commercial utilization of the Wilcox Continuous Miner, it has been recognized that the dual auger cutting mechanism embodied in the Wilcox Miner could be embodied in a mobile crawler type mining mechanism and was not limited in its application to the cable and drum moved shortwall frame with which it was always utilized commercially. For example, one of the earliest Wilcox patents, namely U.S. Pat. No. 2,967,701, contains a disclosure for a mobile crawler type machine utilizing a single auger cutter, (see also U.S. Pat. No. 2,766,809), the patent indicating that a similar arrangement could be utilized in conjunction with a dual auger cutting mechanism as well. Other disclosures with respect to the utilization of dual auger cutting mechanisms in crawler type tractor machines are U.S. Pat. Nos. 2,920,879; 2,986,385; and 3,000,620. To date, as far as applicants are aware, none of these proposals has been commercially utilized.

An object of the present invention is to provide a mobile crawler type mining machine embodying the Wilcox type dual auger cutting head mechanism which is capable of operating at production rates under a wide variety of adverse conditions sufficient to render the same commercially feasible. In accordance with the principles of the present invention, this objective is obtained by providing a machine which is made up of three basic assemblies: (1) an auger drive assembly which includes the dual auger cutters and the drive and individual vertical movement normally provided therefor and which supports the forward end of a conveyor assembly; (2) a mobile assembly which includes the usual crawler units and contains the operator's controls and which supports the rearward end of the discharge conveyor assembly; and (3) a yoke assembly which serves as the connecting link between the auger drive assembly and the mobile assembly providing a pivot axis for vertically lifting and lowering the auger drive assembly with respect to the mobile assembly while simultaneously providing a pivot axis for horizontally swinging the auger drive assembly with respect to the mobile assembly. With this arrangement the machine is able to operate in a variety of seam conditions which undulate in different directions rather severely. In order to achieve such operation the machine provides multiple movements.

First, there is provided individual vertical movement of each auger and auger swing case about the auger swing case pivot axis which allows height adjustment of augers for varying seam heights. Second, there is provided horizontal movement of the auger drive assembly including both augers about the articulated joint pivot axis which allows lateral positioning of the augers and auger drive assembly with respect to the mobile assembly of the machine to facilitate turning the machine in narrow areas and which provides a means of varying the mining width. Third, there is provided vertical movement of the yoke assembly and auger drive assembly about the head lift pivot axis which allows the machine to negotiate front/rear seam undulations. Fourth, there is provided vertical movement of the mobile assembly about the crawler pivot axis. The actuation of both crawlers in the same direction provides a means of raising and lowering front or rear of the machine (see-saw action) to follow an undulating seam. The actuation of one crawler or actuation of both crawlers in opposite directions allows the machine to negotiate a side-to-side seam undulation. Fifth, there is provided vertical movement of the discharge boom about the boom lift pivot axis which allows varying discharge height and further facilitates following an undulating seam. In addition to the above-mentioned basic movements, it is preferable to provide vertical movement of the operator's compartment about the operator's compartment pivot axis which allows the operator's seat to float on the mine bottom regardless of the machine's positioning, thus allowing the operator to take full advantage of seam height where desired. When seam height allows, the seat may be locked in an upward position.

With the provision of these multiple movements the machine is capable of three basic modes or cycles of operation which may be conveniently designated as: one, center sump and shear; two, side sump and shear; and three, simultaneous sump and shear. In the case of center sump and shear, the machine is sumped into the mine material with the auger drive assembly approximately in line with the mobile assembly until the desired depth of penetration is achieved and then forward motion of the machine ceases. At this time, the auger drive assembly is swung to one side, mining material until the desired width of cut in that direction is achieved. It is then returned to its original position to either repeat the cycle or to be swung to the opposite side, mining material until a desired width of cut in that direction is achieved. In the case of side sump and shear, the machine is sumped into the material with the auger drive assembly previously swung to one side of center until the desired depth of penetration is achieved and then forward motion of the machine ceases. At this time, the auger drive assembly is swung while mining material until the desired total width is achieved and then left on that side for the next sump, or returned to the original position for the next sump. In the case of simultaneous sump and shear, the machine is sumped to the desired depth of cut while simultaneously swinging to the desired width of cut: for example, starting at maximum angle right and zero inches depth of cut, the machine advances at a rate which would achieve maximum depth of penetration when the auger drive section has swung to the maximum angle left.

A further object of the present invention is the provision of a machine of the type described which is simple in construction but effective in operation, and economical to manufacture and maintain.

These and other objects of the present invention will become more apparent during the course of the following detailed description and appended claims.

The invention may best be understood with reference to the accompanying drawings, wherein an illustrative embodiment is shown.

In the drawings:

FIG. 1 is a top plan view of the rearward one-third of a continuous mining machine embodying the principles of the present invention;

FIG. 1*a* is a top plan view of the middle one-third of the continuous mining machine;

FIG. 1*b* is a top plan view of the forward one-third of the continuous mining machine;

FIG. 2 is a side elevational view of the rear one-third of the machine;

FIG. 2*a* is a side elevational view of the middle one-third of the continuous mining machine;

FIG. 2*b* is a side elevational view of the forward one-third of the continuous mining machine;

Figure 1:
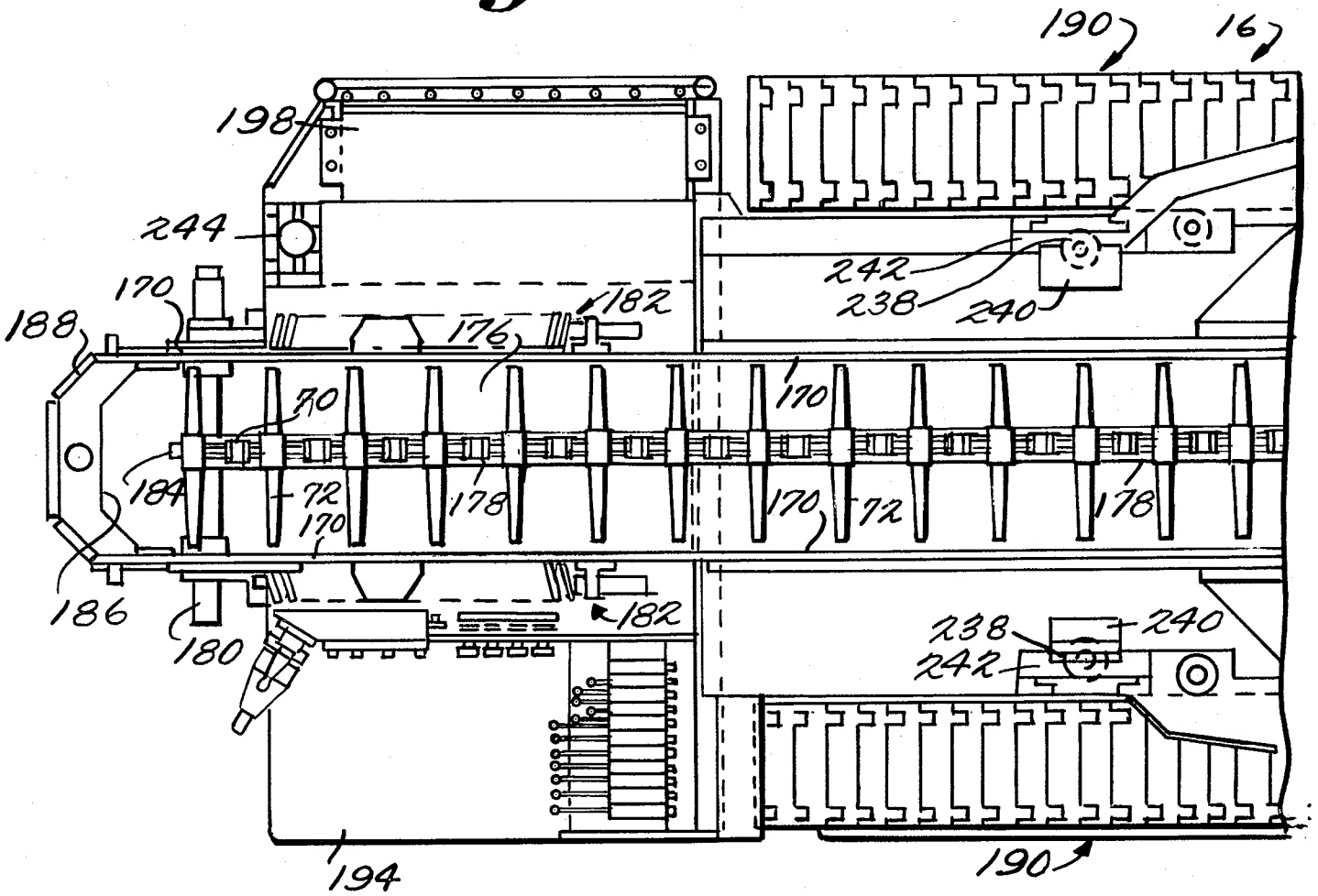
Figure 1A:
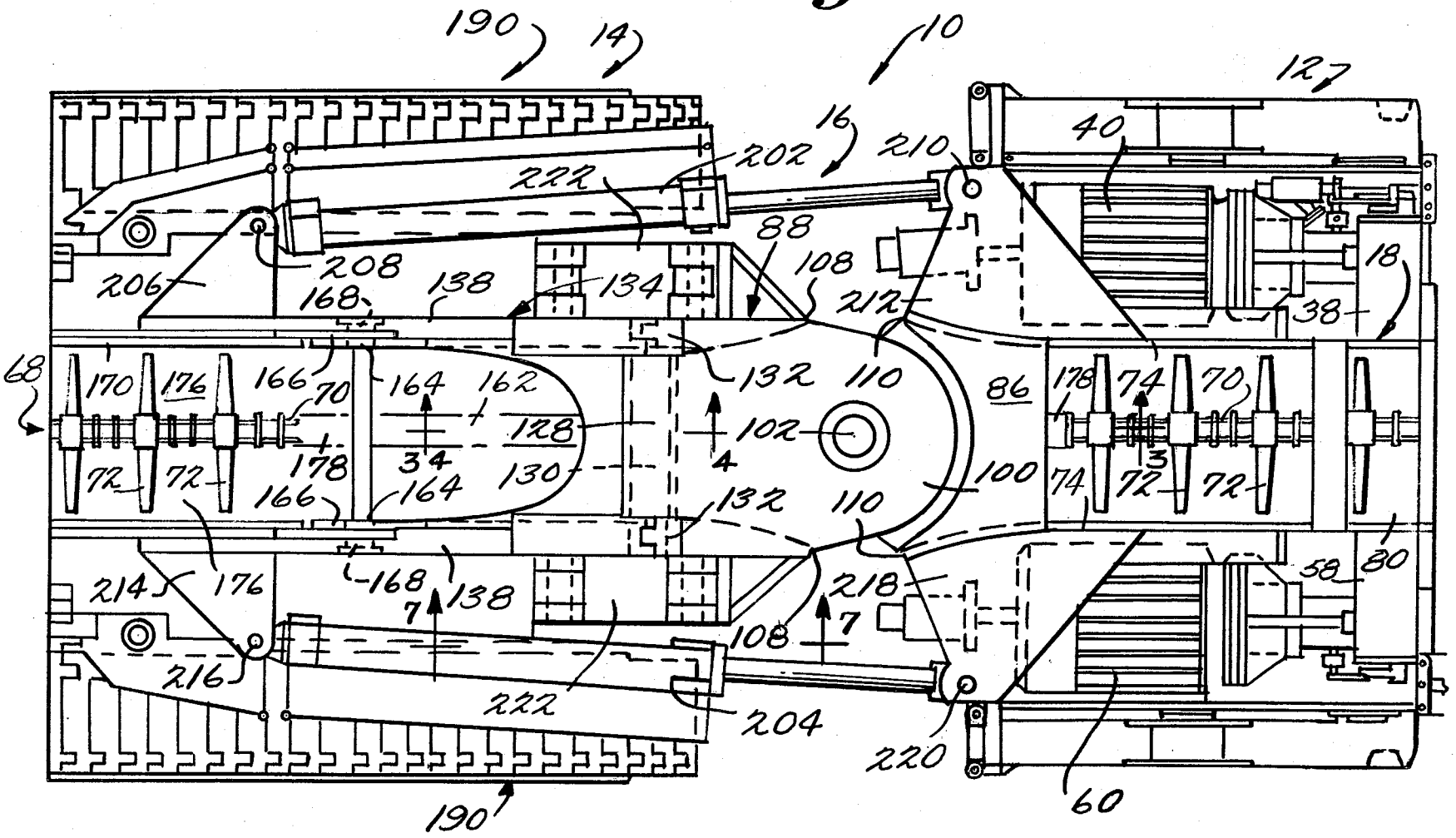
Figure 1B:
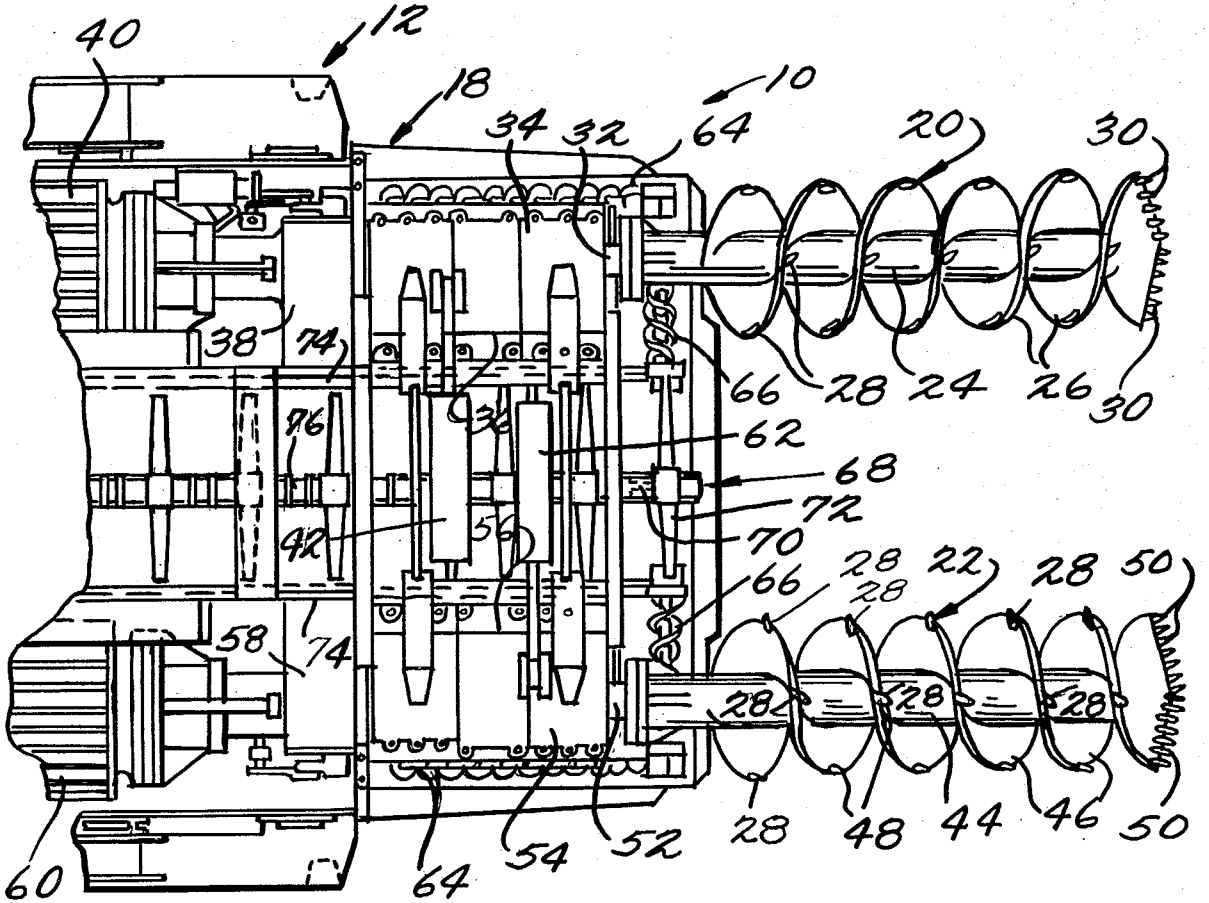
Figures 2, 2A, 2B:
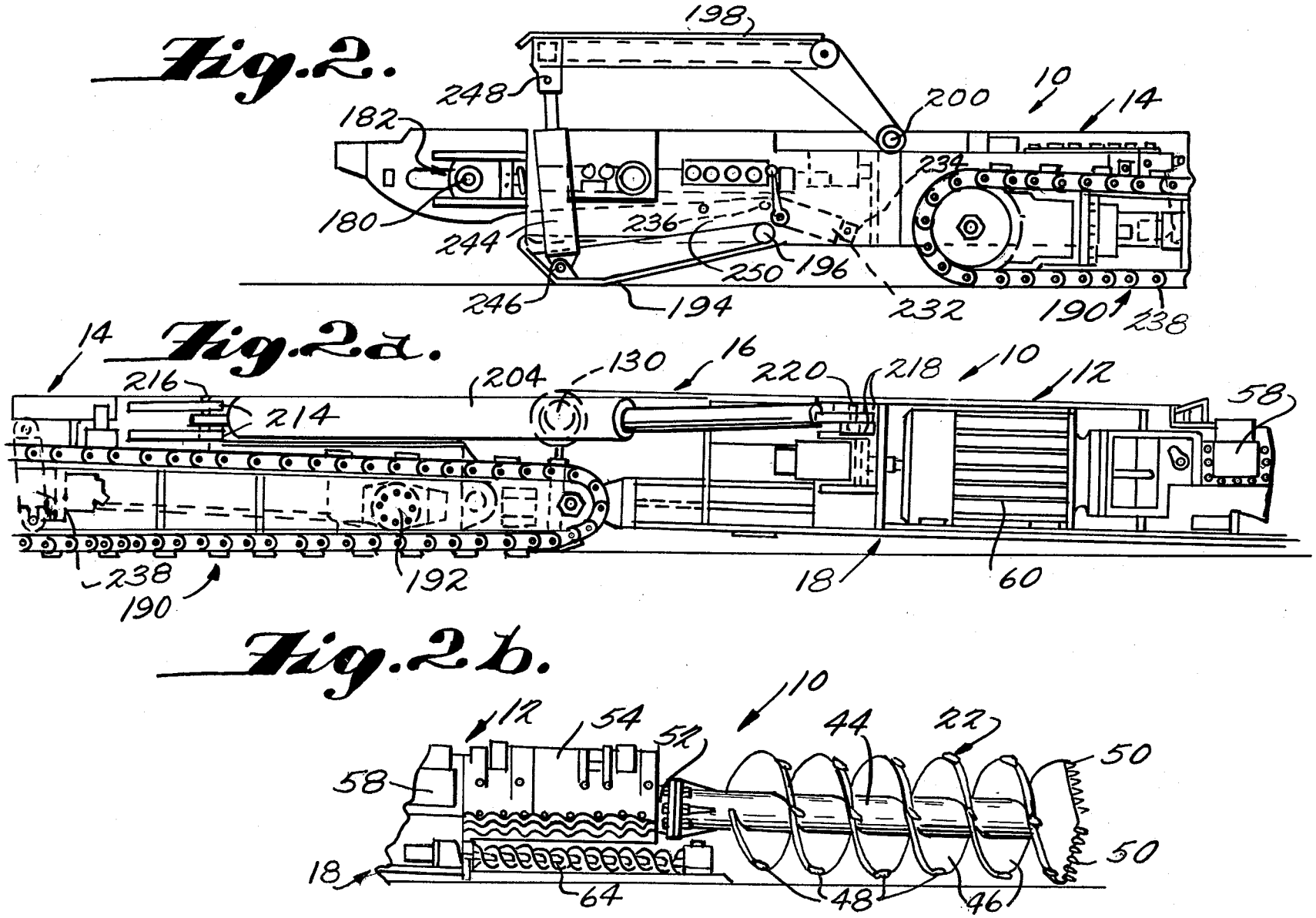

Referring now more particularly to the drawings, there is shown in FIGS. 1 and 2 thereof a continuous mining machine, generally indicated at 10, which embodies the principles of the present invention. The mining machine 10 is made up of three basic assemblies, one of which is a forward cutter assembly, generally indicated at 12. Another one of the three is a rearward mobile assembly, generally indicated at 14, and the third is a yoke assembly, generally indicated at 16, which is between the forward cutter assembly and the rearward mobile assembly. The cutter assembly includes dual auger cutting components constructed essentially in accordance with the cutter assembly of the Wilcox Mark 20 Continuous Mining Machine commercially manufactured by Fairchild Industries, the assignee of the present application. As shown, there is provided a cutter frame section or structure 18 extending forwardly of which is a pair of auger cutters 20 and 22. As shown, auger cutter 20 includes longitudinally extending shaft 24 having a pair of helical blades 26 extending radially outwardly therefrom, the helical blades being displaced 180° with respect to one another. Extending from the periphery of the helical blades is a multiplicity of spaced cutting teeth 28. A set of forward cutting teeth 30 is mounted on the forward edge of the helical blades so as to render the auger cutter capable of being advanced both longitudinally inwardly along the axis of the shaft 24 as well as laterally thereof. The rearward end of the shaft 24 is connected to the forward end of a driven shaft 32 extending forwardly from a swing case 34 suitably mounted on the frame 18 for pivotal movement about a generally forwardly extending horizontal pivotal axis, indicated by center line 36 in FIG. 1*b*. The crank case includes an input shaft (not shown) driven by a motor 40, both of which are suitably fixedly mounted on the frame structure 18 at one side thereof. The swing case 34 and auger cutter 20 are movable about the pivotal axis 36 so as to raise and lower the latter parallel to its axis by a hydraulic ram 42 suitably fixed at one end to the frame 18 and at its other end with the swing case 34.

Auger cutter 22 is similar to auger cutter 20 in that it includes a longitudinally extending shaft 44, a pair of helical blades 46 displaced 180° from one another, peripheral digging teeth 48 and forward digging teeth 50. It will be noted, however, that the helical blades 46 of the auger cutter 22 are oppositely pitched with respect to the helical blades 26 of the auger cutter 20. The rear end of the shaft 44 of the auger cutter 22 is connected with the output shaft 52 of a swing case 54 similar to the swing case 34. Thus, swing case 54 is mounted on the frame 18 for pivotal movement about a horizontal longitudinally extending axis, indicated by center line 56 in FIG. 1*b*. It will be noted that the pivotal axis 56 is parallel with the axis 36, both of which are, in turn, parallel with the rotational axes of the auger cutters 20 and 22. As before, the input shaft (not shown) of the swing case 54 is driven by transmission assembly 58 which, in turn, is driven by a motor 60, both of which are fixed to the frame structure 18. It will be noted, however, that motor 60 serves to rotate the auger 22 about the longitudinal axis of the shaft 44 thereof in a direction opposite from the direction of rotation of the auger 20 about the axis of its shaft 24 by means of motor 40. The swing case 54 and the auger cutter 22 are moved vertically about the pivotal axis 56 by a hydraulic ram 62 connected at one end to the frame 18 and at its other end to the swing case 54.

The cutter assembly 12 also includes a pair of side gathering scrolls 64 which feed to the pair of forward gathering scrolls 66. The forward gathering scrolls in turn feed to the forward end of an elongated scraper conveyor assembly, generally indicated at 68, a forward end section of which is carried by the central portion of the cutter frame section 18. Conveyor assembly 68 extends rearwardly in supported relation with the mobile assembly 14 so as to convey rearwardly of the machine coal cut by the auger cutters at the forward end of the machine.

The scraper conveyor assembly 68 may be of any conventional construction and, as shown, embodies the principles enunciated in commonly-assigned U.S. Pat. No. 4,096,307 which disclosure is hereby incorporated by reference into the present specification. As shown, the scraper conveyor assembly includes a single central chain 70 having cantilevered flight sections 72 extending transversely outwardly therefrom at longitudinally spaced positions therealong.

As best shown in FIG. 1*b* the forward section of the scraper conveyor includes two conveyor side walls 74 suitably fixed to the cutter frame 18. Fixedly extending between the side walls 74 so as to define therewith a conveyor pan section is a horizontal wall 76. In accordance with the disclosure contained in the aforesaid U.S. Pat. No. 4,096,307, the horizontal wall 76 extends between the side walls 74 at an intermediate vertical level. The upper central portion of the horizontal wall 76 receives a laminate construction 78 which serves to quietly support the movement of the scraper conveyor chain 70 thereover so that the flight sections 72 extending laterally therefrom will be moved in operative relation over the upper surface of the horizontal wall 76 on opposite sides of the laminate 78. Also as disclosed in the aforesaid patent, a bottom horizontal wall 80 extends between the lower edges of the side walls 74, the space between the horizontal wall 76 and bottom wall 80 accommodating the return flight of the endless chain 70 and flight sections 72 carried thereby. Again, in accordance with the disclosure contained in the aforesaid U.S. Pat. No. 4,096,307, the space accommodating the return flight is provided with laminate construction 78 both below the horizontal wall 76 and above the bottom wall 80.

It will be understood that the endless chain 70 is trained about a forward sprocket (not shown) which is mounted adjacent the forward end edge of the horizontal wall 76 so that as the chain 70 moves around the forward sprocket, the flight sections 72 are carried upwardly and over the upwardly facing surface of the horizontal wall 76. Coal particles conveyed toward the center of the cutter frame 18 by the action of the clean-up scrolls 66 and the auger cutters are thus fed to and carried rearwardly by the scraper conveyor in the usual fashion. The rearward end of the forward section of the scraper conveyor assembly 68 is connected with the forward end of an intermediate section of the scraper conveyor assembly constituting a part of the yoke assembly 16. To this end, it will be noted that the bottom horizontal wall 80 has fixedly mounted therebelow a pivot plate 82 which extends rearwardly therefrom. An upper pivot plate 84 is fixedly mounted to an upper cross member 86 extending between the upper ends of the side walls 74 at the rearward end of the forward section of the scraper conveyor.

Figure 3:
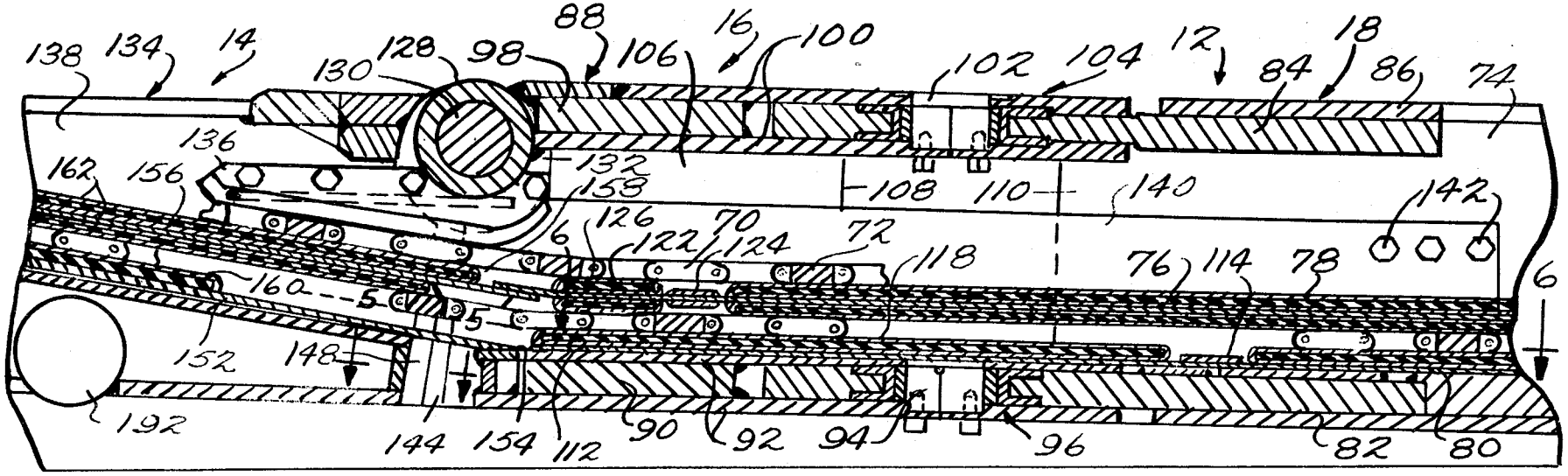
FIG. 3 is an enlarged fragmentary cross-sectional view taken along the line 3—3 of FIG. 1*a;*

As best shown in FIG. 3 the yoke assembly 16 includes a frame structure, generally indicated at 88, which includes a lower horizontally extending frame member 90 having a pair of pivot plates 92 fixedly mounted above and below the same in horizontally forwardly extending relation. The forwardly extending portions of the pivot plates 92 slidably receive therebetween the rearwardly extending portion of the pivot plate 82, the plates including common vertically extending openings for receiving a pivot shaft section 94 therethrough which cooperates with a spherical pivot bearing 96 carried by the pivot plate 82.

The yoke frame structure 88 also includes an upper horizontally extending frame member 98 which is disposed in generally parallel relation above the frame member 90 and has a pair of upper mounting plates 100 fixed to the upper and lower surfaces thereof in forwardly horizontally extending relation. The forwardly extending portions of the pivot plates 100 slidably receive therebetween the rearwardly extending portion of the pivot plate 84, these plates likewise being apertured to receive a pivot shaft 102 which cooperates with a spherical bearing assembly 104 carried by the mounting plate 84.

The yoke frame structure 88 also includes a pair of side walls 106 rigidly interconnected between the upper and lower frame members 90 and 98. It will be noted that the forward end portions of the side walls 106 diverge forwardly and outwardly and terminate rearwardly of the common axes of the two shafts 94 and 102, as indicated at 108. Similarly it will be noted that the rearward portions of the side walls 74 associated with the forward section of the scraper conveyor diverge outwardly with respect to each other, as indicated at 110, and terminate at a position spaced forwardly of the common vertical axis of the two pivot shafts 94 and 102.

Figure 6:
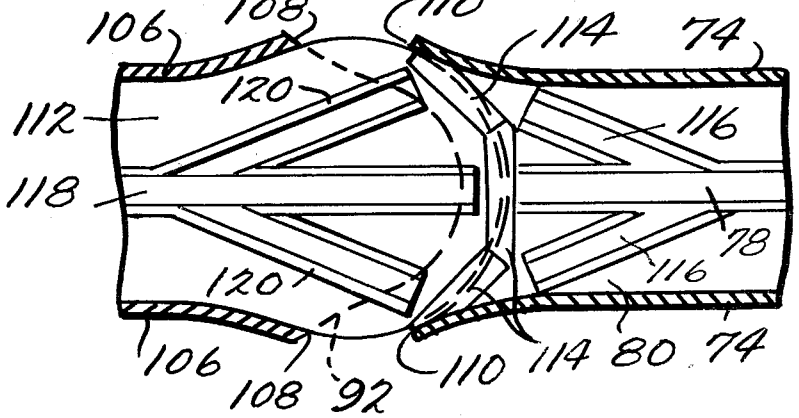
FIG. 6 is a reduced fragmentary sectional view taken along the line 6—6 of FIG. 3.

The diverging relationship of side walls 108 and 110 serves to accommodate the relative pivotal movement between the cutter frame structure 18 and the yoke frame structure 88 about the vertical axis of the shafts 94. In this regard, it will be noted that the bottom portion of the yoke frame structure 88 which defines the intermediate section of the conveyor assembly includes a bottom wall 112 which extends between the side walls 108 above the upper one of the pivot plates 92, the bottom wall 112 having a forwardly extending arcuate configuration concentric with the axis of rotation of the pivot shafts 94. The forwardly extending arcuate marginal edge of the bottom wall 112 has a series of plates 114 mounted in overlapping relation therewith, which plates are fixedly secured as by welding or the like to the rearward marginal edge portion of the bottom wall 80 of the cutter frame structure 18. As best shown in FIG. 6, the rearward edge of the bottom wall 80 has a concave arcuate configuration which is complementary with the convex arcuate configuration of the forward edge of the bottom wall 112.

To insure quiet support of the scraper conveyor chain and flights throughout the range of relative pivotal movement provided, the laminate structure 78 provided on the bottom wall 80 is formed with angular forwardly converging wing portions 116. The bottom wall 112 of the yoke section has a laminate construction 118 mounted centrally thereon, which laminate construction includes a pair of forwardly diverging wing portions 120. Insofar as support of the upper flight of the scraper conveyor is concerned, it will be noted that the horizontal wall 76 extends rearwardly beyond the associated side wall edges 110 and has a rearwardly extending arcuate configuration similar to the forwardly extending arcuate configuration of the bottom wall 112. The yoke section side walls 106 have a horizontal wall 122 fixed thereto and extending therebetween which has a rearward concave arcuate edge complementary to the forward convex arcuate edge of the horizontal wall 76. A series of upper and lower plates 124 similar to the plates 114 are mounted on opposite marginal edge portions of the wall 122 and are disposed in lapped relation with respect to the adjacent marginal edge portion of the horizontal wall 76. Suitable laminate constructions 126 are mounted on the upper and lower surfaces of the horizontal wall 122. These laminate constructions may be provided with rearwardly converging wing portions similar to the wing portions 120 while rearwardly converging wing portions similar to the wing portions 116 may be associated with the rearward portion of the laminate constructions 78 associated with the horizontal wall 76.

Figure 4:
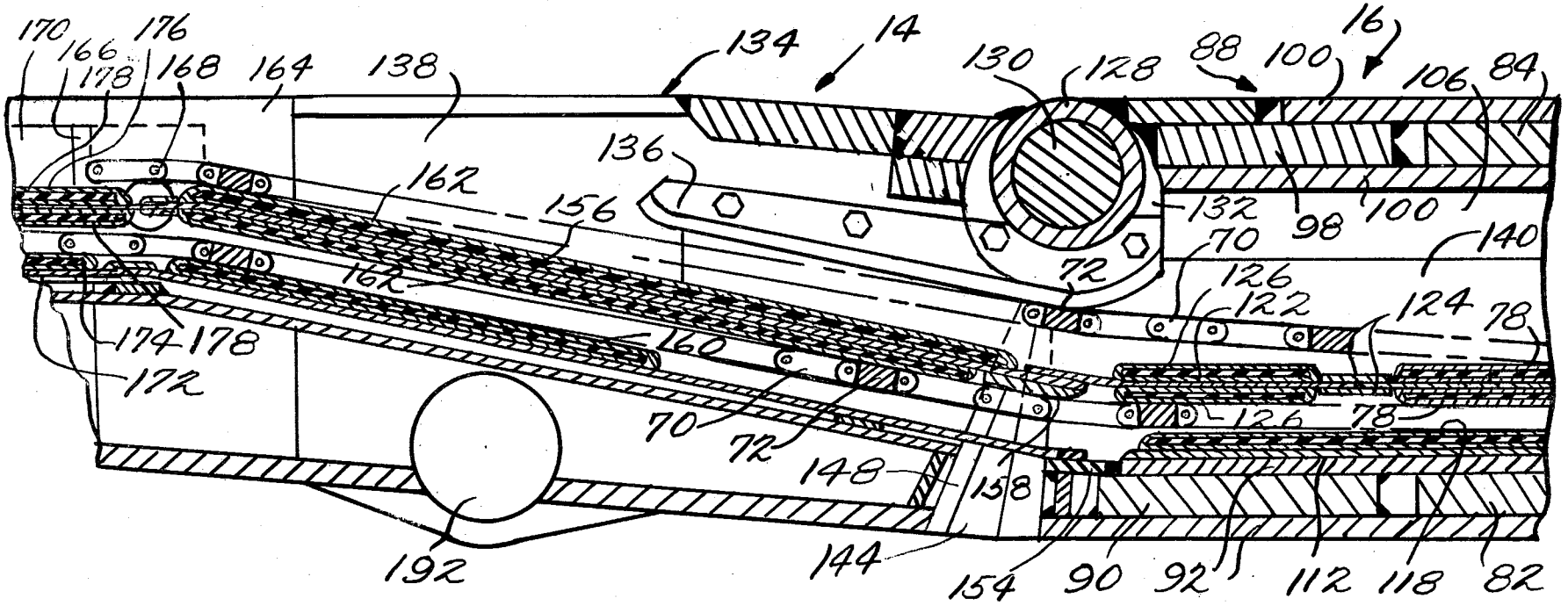
FIG. 4 is an enlarged fragmentary cross-sectional view taken along the line 4—4 of FIG. 1*a;*
Figure 7:
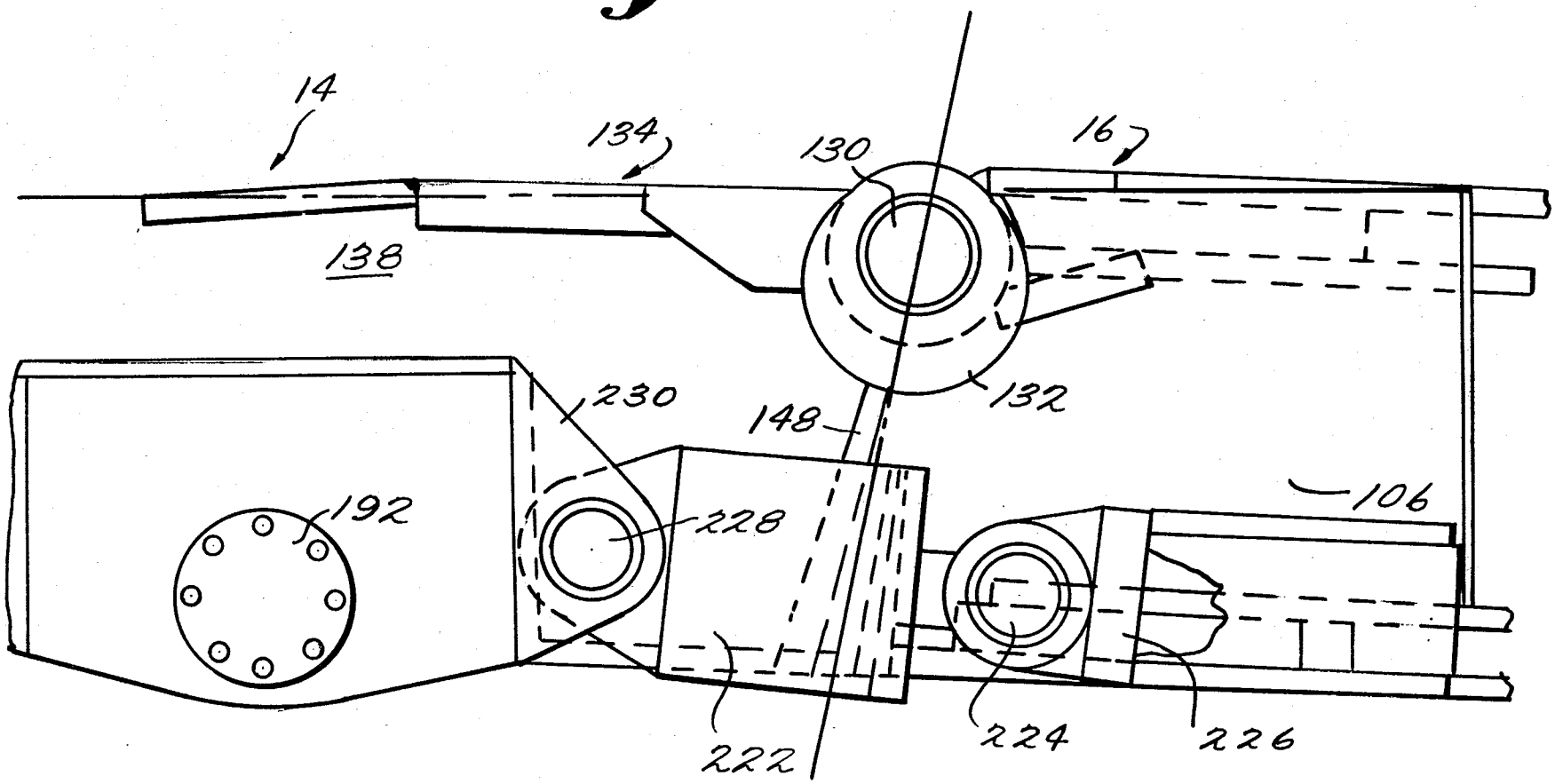
FIG. 7 is a fragmentary sectional view taken along the line 7—7 of FIG. 1*a*.

As best shown in FIGS. 1a, 3 and 4, the rearward end of the upper frame member 98 of the yoke frame structure 88 has rigidly secured thereto, as by welding or the like, a horizontally transversely extending pivot sleeve 128. Journalled within the sleeve 128 is a pivot pin 130 having opposite ends thereof extending outwardly from the sleeve for pivotal connection within a pair of eccentric sleeve members 132 fixedly carried on the forward end of a mobile frame structure, generally indicated at 134, embodied within the mobile assembly 14. Fixed to the lower inner portion of each eccentric sleeve member 132 is a flight guiding shoe 136. Each shoe extends rearwardly from the associated sleeve member 132 and is secured to an associated conveyor side wall or frame member 138 which forms a part of the mobile frame structure 134.

In order to prevent mined material being moved rearwardly along the horizontal walls 76 and 122 by the scraper conveyor flights from moving laterally outwardly through the space provided between the side wall edges 108 and 110, there is provided along each associated pair of side walls 106 and 74 in a position above the associated horizontal walls 76 and 122 a flexible side wall strap 140. Each strap 140 is connected, as by bolts 142, to the associated side wall 74 and extends rearwardly alongside the associated side wall 106. The rearward end portion of each side wall strip 140 is tapered and is adapted to slidably engage between the inner surface of the associated mobile frame structure side wall 138 and the associated shoe 136. It can be seen that the fixed connection of each strap 140 with the associated side wall 74 cooperates with the sliding connection provided by the associated shoe 136 to enable the strap to bridge the gap between the associated side wall edges 108 and 110 as these edges move toward and away from one another during the relative pivotal movement between the cutter frame structure 18 and the yoke frame structure 88. Moreover, the arrangement is such as to accommodate any position of relative movement between the yoke frame structure 88 and the mobile frame structure 134 about the horizontal axis of the pivot pin 130.

Figure 5:
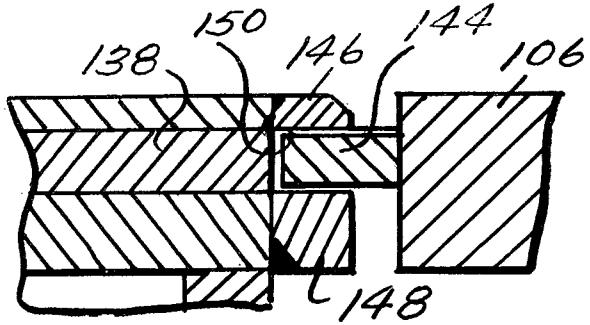
FIG. 5 is an enlarged fragmentary cross-sectional view taken along the line 5—5 of FIG. 3.

With respect to the latter movement it is preferable to provide a tongue and groove relationship between the edges of each pair of cooperating side walls 106 and 138. As best shown in FIG. 5, this preferred construction is provided by welding a tongue plate 144 to the rearward edge of the side wall 106 and two groove defined plates 146 and 148 to the forward edge of the composite side wall 138. Each pair of plates 146 defines with the associated side wall 138 a groove 150 which receives therein the associated tongue plates 144.

Mobile frame structure 134 provides between the side walls 138 a rearward intermediate section of the scraper conveyor assembly which cooperates with the forward intermediate section of the scraper conveyor assembly provided by the yoke assembly 16. To this end, the mobile frame structure 134 includes a bottom wall 152 which extends between the side walls 138 in upwardly and rearwardly inclined relation. The edges of the bottom wall 152 are rigidly secured, as by welding or the like, to the associated side walls 138 throughout their extent except at the forward portion thereof. In this regard it will be noted that the bottom wall 152 includes a forward portion which extends forwardly beyond the forward edges of the side walls 138 past the rearward edges of the side walls 106 into sliding engagement with an upwardly facing surface provided by a transversely extending frame member 154 fixedly secured between the side walls 106 at a position rearwardly of the terminal edge of the bottom wall 112 thereof. Since the bottom wall 152 has a forward portion which is free to flex by virtue of not being fixed to the side walls 138, such flexure may take place during the relative pivotal movement between the yoke frame structure 88 and the mobile frame structure 134 about the horizontal axis of the pivot pin 130.

The rearward intermediate section of the scraper conveyor assembly is also defined by an upwardly and rearwardly inclined wall 156 which is mounted between the side walls 138 in a manner similar to the bottom wall 154. The cantilevered forward portion of the bottom wall 156 includes a curved stiffener plate 158 on the lower surface thereof which serves to maintain the forward end portion of the wall 156 in lapped relation with the rearward end of the wall 122 of the yoke frame structure 88 during relative pivotal movement between the mobile and yoke assemblies. As before, bottom wall 152 has a laminate structure 160 secured to the upper surface thereof and laminate structure 160 secured to the upper surface thereof and laminate structures 162 are secured both to the upper and lower surfaces of the wall 156.

As best shown in FIGS. 1*a* and 4, the portion of each side wall 138 adjacent the rearward end portion of the walls 152 and 156 is formed with a bifurcated construction, as indicated at 164. Each bifurcated structure 164 provides two spaced plate-like elements within which is received a side wall mounting plate 166. Each side wall mounting plate 166 is mounted for pivotal movement between the associated bifurcated structure by a transversely horizontally extending pivot pin 168. The plates 166 form the forward portion of a pivoted rear conveyor pan section which extends beyond the rearward end of the machine. The pivoted rear section of the conveyor includes parallel side walls 170 fixedly secured at their forward ends to the mounting plates 166, a bottom wall 172 having a laminate structure 174 on the upper surface thereof and a horizontally extending wall 176 provided with laminate structure 178 on opposite sides thereof.

As best shown in FIG. 1 there is provided on the rearward end portions of the side walls 170 a transversely extending shaft 180 adjustably mounted, as by take-up assemblies 182, in a position extending between the rearward end portions of the side walls 170. Shaft 180 has fixedly mounted on the central portion thereof a sprocket wheel 184 around which the scraper chain 70 is trained so that the flights 72 will serve to move mined material beyond the rearward edge of the wall 176 through a discharge opening 186 defined by a spaced rear end wall 188. It will be understood that the pivoted rearward conveyor section can have connected therewith at its discharge end the feed end of an additional conveyor section which can be universally connected therewith for both tilting and horizontal swinging movement. In this regard, reference is made to the aforesaid Todd U.S. Pat. No. 3,306,667.

The mobile assembly is supported by a pair of power driven endless track assemblies 190 mounted on the opposite sides of the central portion thereof. The endless track assemblies 190 are connected to the mobile frame structure 134 by a pair of axially aligned shafts 192. As best shown in FIGS. 3 and 4, the shafts 192 are positioned on the mobile frame structure 134 at positions spaced slightly rearwardly and below the pivot pin 130 with their axes aligned and in parallel relation with the axis of the pivot pin 30. Shafts 192 are fixed to the frame structure 134 and pivotally connected with the associated power driven endless track assembly at a position adjacent the forward end thereof, as shown in FIG. 2*a*.

As best shown in FIGS. 1 and 2 there is provided at the rearward end of the mobile assembly 16 an operator's platform in the form of a horizontally extending bottom plate or runner 194. As shown in FIG. 2 the runner is pivoted at its forward end to the lower rearward portion of the mobile frame structure 134, as indicated at 196. In addition, as an optional feature, a canopy 198 may be provided which is pivotally mounted at its forward end to the mobile frame structure 134, as indicated at 200.

A power operated means is provided for effecting the various movements provided by the components thusfar described. Preferably, such means takes the form of hydraulic rams similar to the hydraulic rams 42 and 62 utilized to effect the swinging movement of the swing cases 34 and 54 together with the associated auger cutters 20 and 22. It will be understood that the various hydraulic rams are embodied within a pressurized hydraulic fluid system which includes suitable pumps for pressurizing the hydraulic fluid and valves for controlling the movement of the hydraulic fluid to and from the various hydraulic rams provided.

The relative pivotal movement between the cutter assembly 12 and the yoke assembly 14 about the common pivotal axis provided by the vertical shafts 94 and 102 is effected by a pair of generally longitudinally extending hydraulic rams 202 and 204. As shown, the cylinder end of the hydraulic ram 202 is connected to the adjacent side wall 138 in laterally outwardly spaced relation by means of a bracket 206. As shown, a vertical pivotal connection 208 is provided between the bracket 206 and cylinder end of the hydraulic ram 202. The piston rod end of the hydraulic ram 202 is connected as by a vertical pivot pin 210 to a bracket 212 rigidly secured and extending laterally outwardly from the rear end of the associated side wall 74 of the cutter frame structure 18. The hydraulic ram 204 is similarly connected outwardly of the other side of the machine by bracket 214 secured to the associated side wall 138, vertical pivot pin 216 between the bracket 214 and the cylinder end of the hydraulic ram 204, bracket 218 fixed to the associated side wall 74 and pivot pin 220 between bracket 218 and the piston rod end of the hydraulic ram unit 204. Preferably the hydraulic rams are of the double acting type although it will be appreciated that single acting units may be employed if desired.

As will be apparent from FIG. *2a*, the vertical position of the hydraulic rams 202 and 204 and specifically the vertical position of their connecting pins 208, 210, 216 and 220, is at a level substantially within a horizontal plane passing through the axis of the pivot shaft 130. With this arrangement there is little if any relative movement between the respective hydraulic ram unit connections when the yoke frame structure 88 is moved relatively with respect to the mobile frame structure 134 about the axis of the pivot pin 130. The connection of the hydraulic rams to the various pivot pins accommodates the limited amount of articulation necessary.

The aforesaid relative movement about the axis of pivot pin 130 is accomplished by a pair of hydraulic rams 222. These two hydraulic ram units are mounted on opposite sides of the side walls 106 of the yoke frame structure 88 in a position extending rearwardly therefrom spaced below the associated pivot pin. The piston rod end of each unit 222 is connected as by a horizontal connecting pin 224 to a bracket structure 226 fixedly secured to the associated yoke frame side wall 106. The cylinder end of each hydraulic ram 222 is connected, as by a horizontal pin 228, to a bracket structure 230 fixed to the associated mobile frame side wall 138. Hydraulic ram units 222 are operated together to move the entire yoke frame structure about the axis of pivot pin 130.

FIG. 2 illustrates a single centrally located hydraulic ram 232 which is operable to effect the swinging movement of the rear conveyor section about the pivotal axis provided by the pivot pins 168. As shown, the piston rod end of the ram 232 is connected as by a horizontal pivot pin 234 to a bracket fixed in the lower central portion of the mobile frame structure 134. The hydraulic ram unit 232 extends rearwardly and slightly upwardly from the pivot pin 234 and is connected, as by a pivot pin 236, to the adjacent central lower portion of the bottom wall 172 of the rearward conveyor section.

Each of the power driven endless track units 190 is independently pivotally moved about the common axis provided by the associated connection 192 by a hydraulic ram 238, the upper cylinder end of which is connected as by a horizontal pin to a bracket 240 fixed to the associated side of the mobile frame structure 134 and its piston rod end secured as by a horizontal pivot pin to a bracket 242 secured to the adjacent inner portion of the frame of the associated endless track assembly 190.

FIG. 2 also illustrates the provision of a hydraulic ram 244 connected as by a pivot pin 246 at its cylinder end to the operator's skid plate 194 and at its piston rod end by a horizontal pin 248 to the rearward portion of the canopy 198. While the operator's platform 194 normally rides on the ground it is capable of being locked in a raised position, as by a manually actuated locking mechanism 250.

OPERATION

The machine 10 of the present invention provides three basic cutting modes or cycles, although the operation is not limited thereto. One cutting cycle, which can be referred to as the center sump and shear cycle, involves the movement of the machine into the mine vein with the cutter assembly 12 approximately in line with the mobile assembly 14 until the desired depth of penetration is achieved at which time forward motion of the machine is halted. At this time the cutter assembly is swung to one side mining material until the desired width of cut in that direction is achieved. It is then returned to its original position to either repeat the cycle or to be swung to the opposite side mining material until a desired width of cut in that direction is achieved.

A second cutting cycle may be referred to as the side sump and shear cycle. In this cycle, the machine is sumped into the mine vein with the cutter assembly previously swung to one side of center until the desired depth of penetration is achieved and then the forward motion of the machine is stopped. At this time the cutter assembly is swung while mining material until the desired total width is achieved. The machine is then either left in that position for the sump of the next cycle or returned to the original position for the sump of the next cycle.

The third mode is one which can be termed the simultaneous sump and shear. In this case the machine is sumped into the desired depth of cut while simultaneously swung to the desired width of cut. For example, starting at maximum angle right and zero inches depth of cut, the machine advances at a rate which would achieve maximum depth of penetration when the cutter assembly has swung to maximum angle left.

It will be understood that the sumping movement of the machine is achieved by operating the power operated endless track units 190. These units are also used to transport the machine from one cutting position to another within the mine. The hydraulic rams 42 and 62 of the cutting assembly are utilized to raise and lower the respective auger cutters 30 and 22 in the usual fashion. The swinging movement of the cutting assembly to the left is accomplished by extending the hydraulic ram unit 204 while simultaneously retracting the hydraulic ram unit 202. The opposite swing is accomplished by extending the hydraulic ram unit 202 while simultaneously retracting the unit 204. Fore-to-aft undulations in the seam during the advancing movement are accommodated by actuating hydraulic rams 222 which serve to raise and lower the yoke assembly and cutting assembly together with respect to the mobile assembly. Hydraulic rams 238 likewise can be actuated together to effect adjustment of the entire mechanism about a central transverse pivotal axis and hydraulic ram 232 can be actuated to achieve a desired vertical position of the discharge end of the conveyor assembly.

A side-to-side undulation in the mine seam is accommodated by extending only one of the hydraulic ram units 238 associated with only one of the endless track assemblies 192 or effecting such movement while simultaneously retracting the hydraulic ram 238 associated with the other assembly.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. A continuous mining machine comprising:

a cutter assembly including a cutter frame, a pair of oppositely pitched auger cutters having their axes of rotation disposed generally parallel with respect to one another, means mounting each of said auger cutters on said cutter frame with the rotational axis thereof extending longitudinally forwardly for independent vertical pivotal movement about a pivotal axis parallel with its axis of rotation, means for effecting a vertical pivotal movement of each auger cutter independently about its pivotal axis with respect to said cutter frame, means carried by said cutter frame for rotating said auger cutters in opposite directions about their rotational axes in any position of vertical pivotal movement thereof, a mobile assembly disposed rearwardly of said cutter assembly and including a pair of parallel power driven endless track units, a mobile frame, means mounting said mobile frame between said endless track units for independent pivotal movement of each unit about a common generally transversely extending horizontal axis disposed adjacent to the forward portion of said track units, means between the rearward portion of each track unit and said mobile frame for effecting independent pivotal movement of each track unit about said common pivotal axis with respect to said mobile frame, a yoke assembly between said mobile assembly and said cutter assembly including a yoke frame, means pivotally interconnecting said yoke frame with said mobile frame for pivotal movement about an axis generally parallel with the common pivotal axis of said track units, means pivotally interconnecting said yoke frame with said cutter frame for pivotal movement about a generally upright axis extending generally perpendicularly to the pivotal axis of said yoke frame with said mobile frame, means for effecting a pivotal movement of said cutter frame horizontally about its upright pivotal axis with said yoke frame, means for effecting pivotal movement of said yoke frame and said cutter frame vertically about the pivotal axis of said yoke frame with respect to said mobile frame, and conveyor means including a forward section carried by said cutter frame and a rearward section carried by said mobile frame for conveying coal cut by said auger cutters longitudinally rearwardly of the machine, means pivotally mounting the forward portion of the rearward conveyor section on said mobile frame for pivotal movement about an axis parallel to the common pivotal axis of said track units and means between the rearward portion of said rearward conveyor section and said mobile frame for effecting pivotal movement of said rearward conveyor section about its pivotal axis with respect to said mobile frame.

2. A continuous mining machine as defined in claim 1 wherein the pivotal axis of said yoke frame with said mobile frame is forwardly and above the common pivotal axis of said endless track units.

3. A continuous mining machine as defined in claim 2 wherein the upright pivotal axis of said yoke frame with said cutter frame is spaced forwardly of the pivotal axis of said yoke frame with said mobile frame.

4. A continuous mining machine as defined in claim 1, 2 or 3 wherein said conveyor means is a scraper conveyor including a plurality of sections each of which includes a pair of side walls having a bottom wall and a parallel wall above said bottom extending therebetween, endless chain means and a multiplicity of transversely extending scraper bars carried by said endless chain means, said endless chain means being mounted for movement in a direction to move said scraper bars rearwardly in an operative flight along said parallel walls and forwardly in a return flight along said bottom walls.

5. A continuous mining machine as defined in claim 4 wherein said conveyor means further includes resilient laminate constructions on opposite surfaces of said parallel walls and on the upper surface of said bottom walls for quietly supporting said endless chain means and scraper bars.

6. A continuous mining machine as defined in claim 1, 2 or 3 wherein said means for effecting independent pivotal movement of said auter cutters comprises a hydraulic ram between said cutter frame and each of said auger cutters.

7. A continuous mining machine as defined in claim 1, 2 or 3 wherein said means for effecting pivotal movement of said cutter frame horizontally about its upright pivotal axis with said yoke frame includes a pair of generally horizontally extending hydraulic rams on opposite sides of said upright axis connected at one of their ends with said mobile frame and at the other ends with said cutter frame, the end connections of said pair of hydraulic rams being disposed at a vertical level generally the same as the vertical level of the pivotal axis of said yoke frame with said mobile frame.

8. A continuous mining machine as defined in claim 1, 2 or 3 wherein the means for effecting vertical pivotal movement of said yoke frame and said cutter frame with respect to said mobile frame includes a pair of hydraulic rams each connected between said mobile frame and said yoke frame at a position below the horizontal pivotal axis of said yoke frame with said mobile frame.

9. A continuous mining machine as defined in claim 1, 2 or 3 wherein said mobile frame has an operator's platform pivotally mounted thereon for vertical swinging movement at a position adjacent the rearward portion thereof.

10. A continuous mining machine as defined in claim 9 wherein said mobile frame has a canopy structure pivotally mounted thereon at a position adjacent the rearward portion thereof.

11. A continuous mining machine as defined in claim 10 wherein hydraulic ram means is mounted between said operator's platform and said canopy structure.

* * * * *